United States Patent [19]

Gesell

[11] 4,094,284

[45] June 13, 1978

[54] EMISSION CONTROL SYSTEM

[75] Inventor: William Fred Gesell, Huron, Ohio

[73] Assignee: Eltra Corporation, Toledo, Ohio

[21] Appl. No.: 624,494

[22] Filed: Oct. 21, 1975

[51] Int. Cl.[2] ..... F02M 25/06

[52] U.S. Cl. ..... 123/119 A; 137/842

[58] Field of Search ..... 123/DIG. 10, 119 A; 137/804, 837, 840, 842

[56] References Cited

U.S. PATENT DOCUMENTS

| | | | |
|---|---|---|---|
| 3,405,736 | 10/1968 | Reader | 137/842 |
| 3,429,322 | 2/1969 | Metzger | 137/842 |
| 3,579,981 | 5/1971 | Gau | 123/119 A |
| 3,581,719 | 6/1971 | Gau | 123/119 A |
| 3,616,782 | 11/1971 | Matsui | 137/842 |
| 3,618,932 | 11/1971 | Moreland | 137/837 |
| 3,678,733 | 7/1972 | Blatter | 137/842 |
| 3,911,674 | 10/1975 | Goto | 123/119 A |
| 3,928,966 | 12/1975 | Goto | 123/119 A |
| 4,027,635 | 6/1977 | Goto | 123/119 A |

FOREIGN PATENT DOCUMENTS

| | | | |
|---|---|---|---|
| 2,356,871 | 5/1975 | Germany | 123/119 A |

*Primary Examiner*—Douglas Hart
*Attorney, Agent, or Firm*—Robert E. Greenstein

[57] ABSTRACT

Exhaust gas is recirculated to an intake manifold of an engine by a shut-off valve and a fluidic amplifier for modulation in accordance with different engine parameters. The shut-off valve is normally biased to a closed position and it is opened to permit recirculation in response to a signal received from a fluidic NOR gate which operates in accordance with position of a carburetor throttle, engine speed and engine temperature. The fluidic amplifier includes a power jet chamber receiving a supply of exhaust and a vent chamber in fluid communication with a venturi disposed in the exhaust manifold, a receiver chamber and a pair of control jets. One of the control jets may be in fluid communication with the intake manifold or with a carburetor venturi. The other control jet may be open to atmospheric pressure compensated for the effect of changes in air density or engine speed.

43 Claims, 13 Drawing Figures

EMISSION CONTROL SYSTEM

This invention relates to an emission control system for an internal combustion engine such as used in a motor vehicle, and more particularly to an emission control system for reducing the concentration of oxides of nitrogen in the exhaust gases of an automobile engine.

In the operation of an internal combustion engine, undesirable oxides of nitrogen are formed when the temperature of combustion becomes sufficiently high. With the advent of environment pollution standards and the resulting controls for automotive engines, it has become necessary to reduce the concentration of the undesirable oxides of nitrogen in the exhaust gas of the engine to required limits which are becoming progressively lower. Such a reduction may be accomplished by recirculating a portion of the exhaust gas to the intake manifold of the engine where it is added to a combustible air fuel mixture so as to inhibit the formation of oxides of nitrogen during the combustion process. However, the recirculation of exhaust gas adversely affects the performance of the engine by reducing the developed power and increasing the fuel consumption, and the deterioration in engine performance increases as greater portions of exhaust gas are recirculated through the engine. Accordingly, it is desirable to limit the recirculated exhaust gas to an amount which is just sufficient to achieve the necessary reduction in oxides of nitrogen without causing an unnecessary deterioration in engine performance.

In the past, there have been several arrangements for recirculating exhaust gas through the engine and with the amount of recirculated exhaust gas varying in accordance with different parameters of the engine. For example, exhaust gas has been recirculated through a passageway leading from an exhaust manifold to an intake manifold with the amount of recirculating exhaust gas varying with the difference in pressure between the intake and exhaust manifolds as well as the restriction to the flow of exhaust gas through the passageway. Since recirculation of exhaust gas is undesirable while the engine is idling as well as during a full throttle condition, the flow of exhaust gas through the recirculation passageway is controlled by a valve which is opened or closed in accordance with a vacuum signal which is obtained from a vacuum port located in a carburetor above a throttle. However, since the differential pressure determining the flow of recirculating exhaust gas is diminished with the opening of the carburetor throttle, such as emission control system is not suitable for recirculating the large amounts of exhaust gas which are required to meet future reductions in the allowable concentrations of undesirable oxides of nitrogen because engine performance would be adversely affected at light engine loads.

In another arrangement, the flow of exhaust gas through the recirculation passageway has been controlled by a valve which is gradually opened and closed in accordance with a vacuum signal from a carburetor venturi so as to modulate the flow of recirculated exhaust gas in proportion to the engine air consumption. Such as arrangement is shown in U.S. Pat. No. 3,774,583. In still another arrangement the flow of exhaust gas through the recirculation passageway has been controlled by a valve which is gradually opened and closed in response to the back pressure of the engine. However, these prior art arrangements for varying the flow of recirculating exhaust gas require the physical movement of a valve member in the recirculation passageway. Such movement is difficult to control closely and its reliability is affected by vibrations and temperature changes as well as deposits which may form on the valve member from the flow of exhaust gas. Moreover, these arrangements are relatively complicated involving many parts and they are not easily adaptable to varying the flow of recirculated exhaust gas in accordance with other engine parameters or operating conditions as may be required in the future.

Accordingly, an object of the present invention is to provide a method of controlling the amount of exhaust gas recirculated through an internal combustion engine without involving the physical movement of a valve member in the recirculation passageway.

Another object of the invention is to provide an emission control system which is easily adaptable to varying a flow of recirculating exhaust gas in accordance with both internal engine parameters as well as external conditions.

A further object of the invention is to provide an emission control system capable of modulating the flow of the recirculating exhaust gas without being effected by the build up of deposits on the modulating device from the flow of exhaust gas.

An additional object of the invention is to provide a valve arrangement which fully opens or closes the recirculation passageway to the flow of exhaust gas in accordance with predetermined engine operating conditions.

Still other objects, features and advantages of the invention will become apparent to those skilled in the art from a reading of the following detailed description of several embodiments of the invention, taken in conjunction with the accompanying drawing, wherein.

Figure 1:
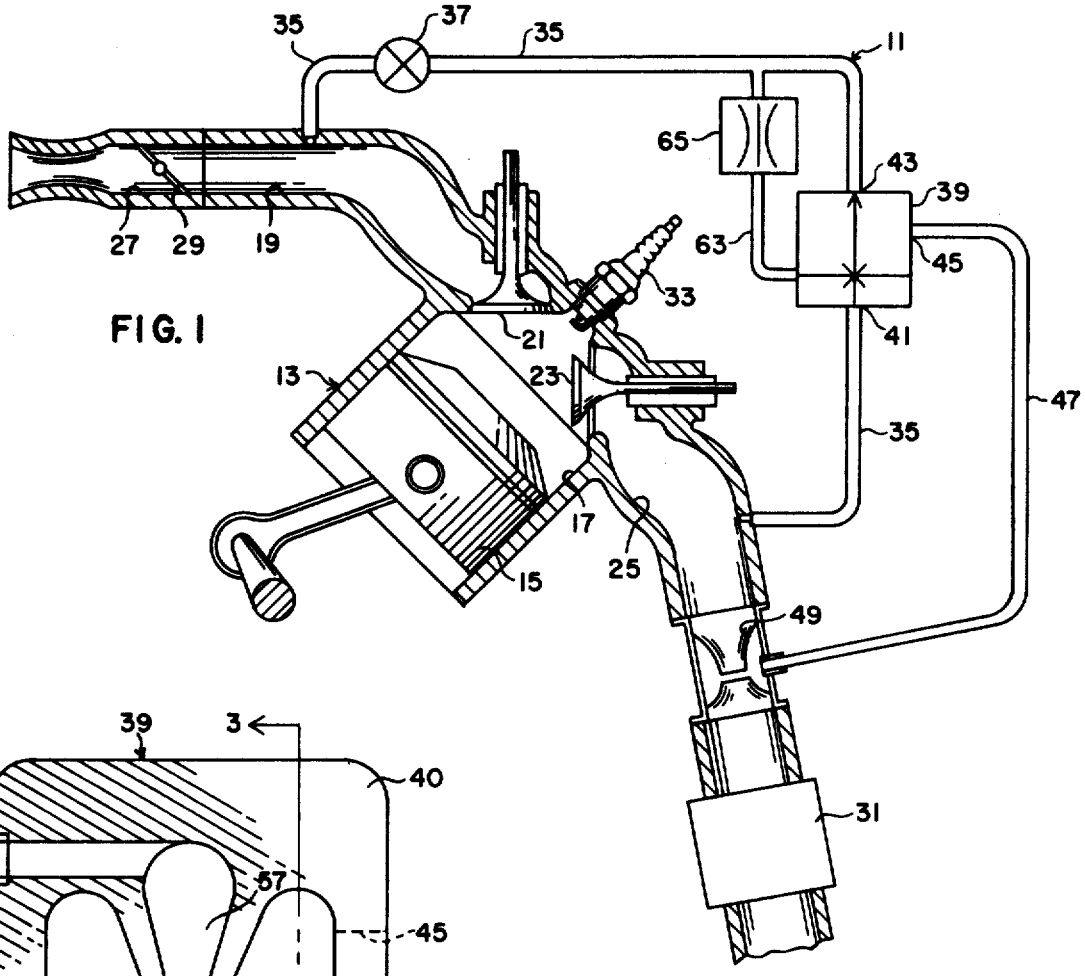
FIG. 1 is a diagrammatic illustration of an internal combustion engine with an emission control system constructed in accordance with the present invention for recirculating exhaust gas in accordance with signals indicative of the intake manifold vacuum pressure as well as the exhaust back pressure.
Figure 12:
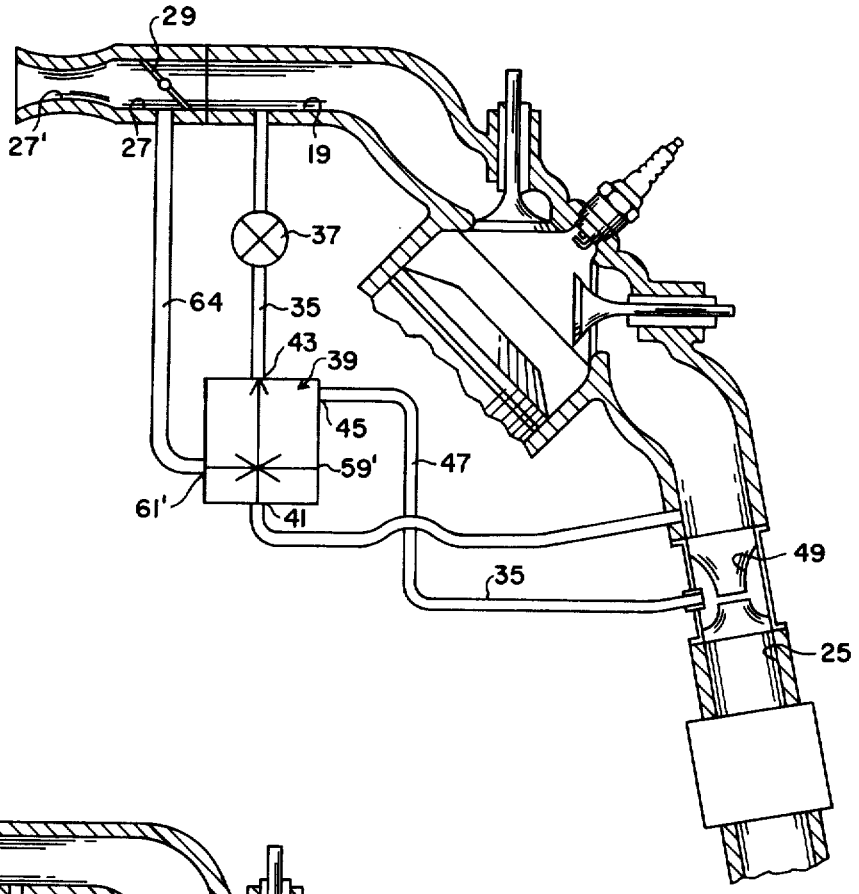
Figure 13:
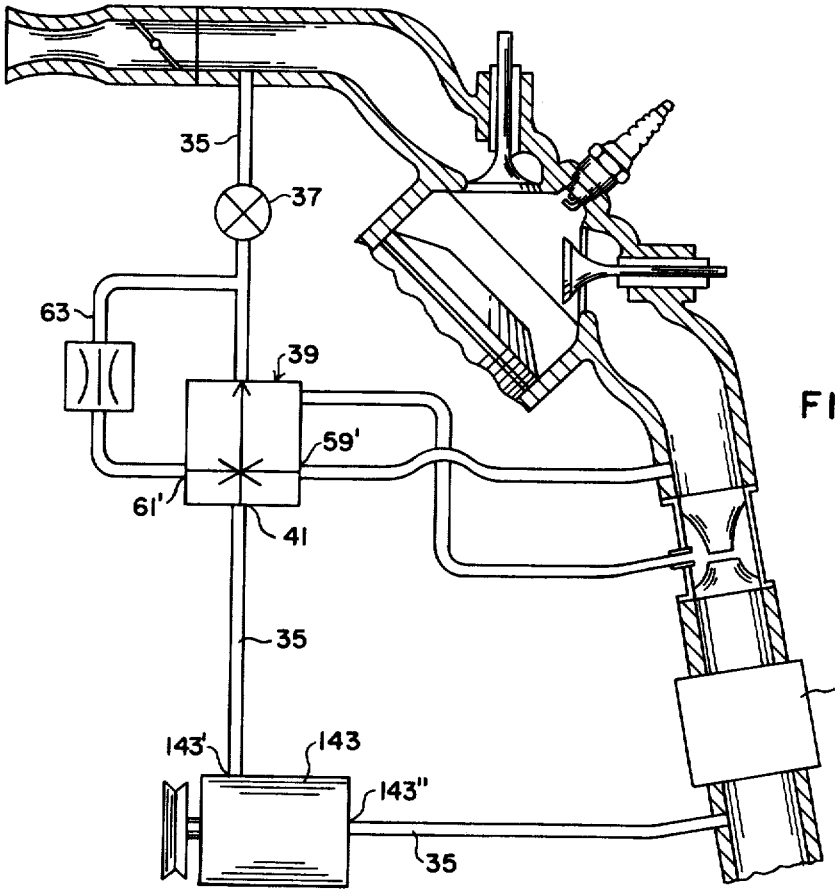

FIG. 12 is a modification of the emission control system of FIG. 1 with the flow of recirculating exhaust gas being modulated in response to a vacuum signal from the carburetor; and FIG. 13 is an alternative arrangement of the emission control system of FIG. 1 with exhaust gas being supplied to the fluidic amplifier in accordance with engine speed while the recirculating flow of exhaust gas is modulated in response to the back pressure of the engine.

Referring now in detail to the figures in the drawing, and more particularly to FIG. 1, there is shown an emission control system, generally indicated 11, for reducing the concentration of undesirable oxides of nitrogen in the exhaust gas of an internal combustion engine, generally indicated 13. As is conventional, the engine 13 includes a piston 15 arranged for a reciprocating movement in a combustion chamber 17 which receives a combustible air fuel mixture from an intake manifold 19 through an intake valve 21 and expels the products of combustion through an exhaust valve 23 into an exhaust manifold 25. The incoming air fuel mixture is provided by a carburetor 27 having a throttle 29 for determining the flow of the air fuel mixture into the intake manifold 19, while the products of combustion which are expelled into the exhaust manifold 25 are passed through a muffler 31 and exhausted into the atmosphere. The intake and exhaust valves 21, 23 respectively, are operated in synchronization with the reciprocating movement of the piston 15 which alternately creates a vacuum drawing the combustible air fuel mixture into the combustion chamber 17 and then compresses it for ignition by a spark plug 33 whereupon the resulting propellant gases drive the piston 15 in a power stroke and are then expelled through the exhaust valve 23 by the returning movement of the piston 15. To reduce the concentration of oxides of nitrogen in the exhaust gas, the emission control system 11 recirculates a portion of the exhaust gas through a recirculation passageway 35 leading from the exhaust manifold 25 to the intake manifold 19 for being drawn into the combustion chamber 15 with an incoming air fuel mixture so as to inhibit the formation of oxides of nitrogen during the combustion process. Details concerning the operation of the engine 13 have not been shown since they form no part of the present invention and may be conventional. Moreover, although the emission control system is illustrated and described in connection with an engine 13 having a single cylinder 17, it is to be understood that it may be used with engines having a plurality of cylinders and that it may also be used with different types of engines.

As previously discussed, the amount of exhaust gas which is recirculated through the engine 13 should be limited to an amount which is sufficient to reduce the concentration of oxides of nitrogen to a required level without unnecessarily retarding the performance of the engine 13. However, the amount of exhaust gas which would normally pass through a recirculation passageway 35 may not be suitable under all conditions since the flow of recirculating exhaust gas would depend upon the differential pressure between the exhaust manifold 25 and the intake manifold 19 as well as the restriction provided by the recirculation passageway 35. The vacuum pressure of the intake manifold 19 may vary from a maximum vacuum pressure when the carburetor throttle 29 is in a substantially closed position during engine idling speeds to a minimum vacuum pressure as the throttle 29 is moved to an open position during a period of rapid engine acceleration or high speed operation. The exhaust gas passing through the exhaust manifold 25 creates a back pressure which is uniform to the restriction normally provided by the muffler 31, and the back pressure varies according to the total gaseous flow through the exhaust manifold 25 so as to increase as the throttle 29 opens and the engine 13 accelerates. Furthermore, the recirculation of any amount of exhaust gas may be undesirable during some engine operating conditions, for example idling, rapid acceleration or high speeds, when it is desirable for the engine 13 to develop full performance.

In accordance with the present invention, the recirculation passageway 35 is made sufficiently large to prevent any unnecessary restriction to the flow of exhaust gas, and the emission control system 11 includes a shut-off valve 37 in the recirculation passageway 35 to prevent the flow of exhaust gas therethrough under certain conditions as will be explained below in further detail. To limit the flow of recirculating exhaust gas to an amount which is sufficient to reduce the undesirable oxides of nitrogen to an acceptable level of concentration without unnecessarily retarding the performance of the engine 13, the emission control system 11 also includes a fluidic amplifier generally indicated 39, for modulating the flow of recirculating exhaust gas in accordance with certain parameters of the engine 13.

As shown, the exhaust gas which is recirculated through the engine 13 passes through the fluidic amplifier 39 from a supply port 41 to an outlet port 43 leading to the shut-off valve 37, and the amount of exhaust gas flowing into the fluidic amplifier 39 is determined by a differential pressure between the supply port 41 and a vent port 45 which is connected by a vent passageway 47 to a relatively low pressure such as atmospheric pressure or a low pressure provided by means in the form of a venturi 49 disposed in the exhaust manifold 25 or any other means having a device for controlling other undesirable pollutants in the exhaust gas before passing it into the atmosphere. As more particularly shown in FIGS. 2 and 3, the supply port 41 of the fluidic amplifier 39 leads to a power jet chamber, generally indicated at 51, with a nozzle portion 51' providing a restriction for accelerating the flow of exhaust gas into a relatively high velocity stream which functions as a beam for passage through an intermediate space, generally indicated at 53, in response to the differential pressure between the supply port 41 and the vent portion 45 of the fluidic amplifier 39. Although some of the exhaust gas will pass into a vent chamber 55 leading to the vent port 45, the beam of exhaust gas will generally maintain its integrity as it passes through the intermediate space 53 and will enter a receiver chamber 57 leading to the outlet port 43 for recirculation through the engine 13.

The flow of exhaust gas through the fluidic amplifier 39 is determined by the differential pressure between the supply port 51 and the vent chamber 55 which is also influenced by the vacuum pressure of the intake manifold 19 until the velocity of the beam of exhaust gas becomes sufficiently high. Accordingly, the amount of exhaust gas which is recirculated through the engine 13 will vary in response to fluctuations in the back pressure of the exhaust manifold 25. However, such limited control of the recirculating exhasut gas may not be sufficient to prevent the engine 13 from stalling while operating at an idling speed or otherwise unnecessarily retarding the performance of the engine 13, and to more closely limit the amount of exhaust gas recirculating through the engine 13 the vacuum pressure of the intake manifold 19 may also be used to vary the amount of exhaust gas entering the receiver portion 57 of the fluidic amplifier 39 for recirculation through the engine 13.

Figure 2:
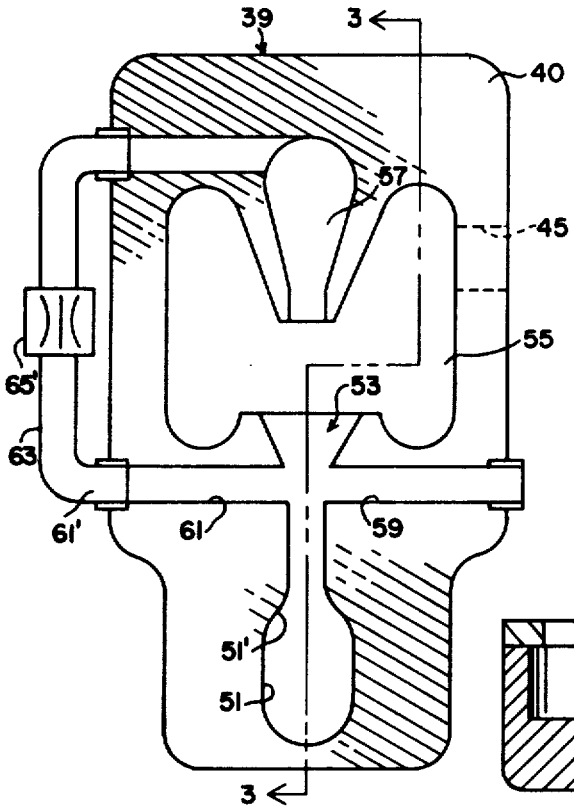
FIG. 2 is a sectional view of a fluidic amplifier shown schematically in FIG. 1.
Figure 3:
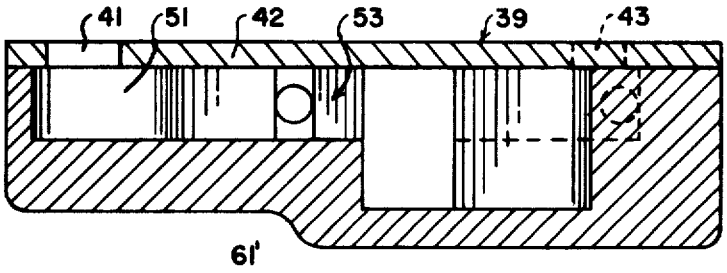
FIG. 3 is a cross-sectional view of the fluidic amplifier shown in FIG. 2 as taken along the line 3—3 in FIG. 2.

As more particularly shown in FIGS. 2 and 3, the fluidic amplifier 39 is provided with a pair of control jets 59, 61 respectively, which are located on laterally opposite sides of the nozzle portion 51' of the power jet chamber 51 for enabling a differential pressure to exert a force on the stream of exhaust gas as it passes into the intermediate space 53 so as to deflect the beam toward the vent chamber 55. The control jet 59 may be open to atmospheric pressure while the other control jet 61 is connected through a feedback passageway 63 providing a suitable restriction 65 to the intake manifold 19 so that fluctuations in the intake manifold pressure will cause corresponding variations in the differential pressure on the beam of exhaust gas. As previously discussed, the vacuum pressure of the intake manifold 19 varies from a maximum pressure when the carburetor throttle 29 is in a substantially closed position to a minimum pressure as the throttle 29 moves to an open position and accordingly the beam of exhaust gas will be gradually deflected from the receiver portion 57 of the fluidic amplifier 39 to the vent portion 55 as the throttle moves toward a substantially closed position resulting in a greater vacuum pressure at the intake manifold 19.

As shown in FIGS. 2 and 3, the fluidic amplifier 39 may be formed in a plate 40 of cast iron or steel, and may desirably be formed integrally with a plate which is mounted between the carburetor 27 and the intake manifold 19 with a portion of the exhaust gas recirculation passageway 35 formed therein. The supply, outlet and vent ports 41, 43, 45 respectively which lead to the associated power jet chamber 51, receiver chamber 57 and vent chamber 55 may be formed in a cover member 42 which is suitably secured over the plate 40, while the control jets 59, 61 may have associated ports 59', 61' formed in the plate 40. The feedback passageway 63 and the associated restriction 65 may be formed in the plate 40 in a conventional manner or be provided externally of the plate 40 in the form of a suitable coiled conduit.

As previously discussed, the recirculation of exhaust gas through the engine 13 may be undesirable during certain periods of engine operation, for example idling, rapid acceleration or high speeds such as corresponding to 55 mph, and to prevent a flow of recirculating exhaust gas the recirculation passageway 35 is provided with valve means in the form of a shut-off valve 37. In the past, such shut-off valves 37 have been opened and closed by the movement of a diaphragm in response to a vacuum signal obtained from a vacuum port in the carburetor 27 such as normally associated with a vacuum advance mechanism of an ignition system of the engine 13. However, such an arrangement for controlling the operation of the shut-off valve 37 is not entirely desirable for use with the fluidic amplifier 39 or with any other system varying the flow of recirculating exhaust gas yet requiring a definite termination of the flow under certain engine operating conditions, because the vacuum signal effecting the movement of the diaphgram is essentially an analog signal which may not fully open or close the shut-off valve 37 at the proper time, resulting in either an undesirable leakage of exhaust gas or an undesirable restriction which interferes with the control of the recirculating exhaust gas provided by the fluidic amplifier 39 or other flow varying system.

Figure 4:
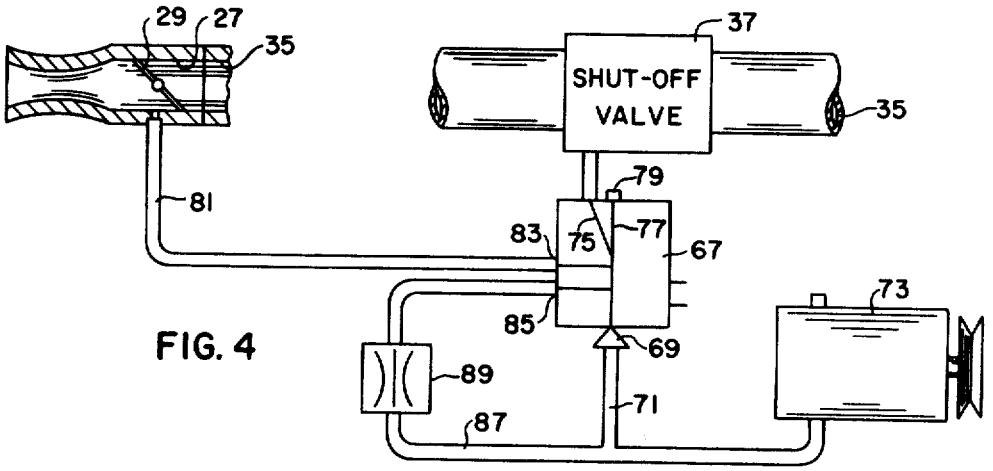
FIG. 4 is a diagrammatic illustration of a fluidic NOR gate responsive to signals indicative of the position of the carburetor throttle and the speed of the engine for controlling a shut-off valve shown schematically in FIG. 1.

In accordance with the present invention, the shut-off valve 37 is normally biased to a closed position as will be explained below in further detail, and the shut-off valve 37 is operated in response to a digital air signal obtained from a control means in the form of a fluidic NOR gate 67 which responds to various engine conditions as shown in FIG. 4 wherein similar reference numerals have been used to indicate similar portions of the engine 13 and the emission control system 11. The fluidic NOR gate 67 has a supply port 69 receiving air through an air passageway 71 from an air pump 73, and the air may flow through the fluidic NOR gate 67 along either of two channels 75 or 77 with the channel 75 leading to the shut-off valve 37 while the other channel 77 leads to an outlet port 79 for venting the air into the atmosphere. The fluidic NOR gate 67 may be of conventional design operating on the wall attachment principle, such as manufactured by Corning Glass Works of Corning, New York, and may be designed so that the stream of air will normally flow along the channel 77 leading to the outlet port 79 unless switched to the channel 75 leading to the shut-off valve 37 in response to a control signal indicative of an engine operating condition, thereby opening and closing the shut-off valve 37 in accordance with the presence or absence of a positive digital air signal.

As previously mentioned the shut-off valve 37 is normally biased to a closed condition, and to open the shut-off valve 37 and enable recirculation of the exhaust gas as the speed of the engine increases from an idling speed, the fluidic NOR gate 67 is provided with a control signal which is indicative of the position of the throttle 29 in the carburetor 27 and deflects the stream of air to the channel 75 for providing a digital air signal to the shut-off valve 37. As shown, the control signal is obtained from just above the throttle 29 of the carburetor 27 which is connected through a vacuum passageway 81 to a control port 83 of the fluidic NOR gate 67. When the throttle 29 is substantially closed corresponding to an idling condition of the engine 13, the pressure just above the throttle 29 corresponds to atmospheric pressure so that the air stream through the fluidic NOR gate 67 is normally vented into the atmosphere as previously described. However, as the throttle 29 is moved to an open position, the pressure in the carburetor 27 beings to approach the vacuum pressure of the intake manifold 35, and when the vacuum signal increases sufficiently it switches the air stream in the fluidic NOR gate 67 to the channel 75 to open the shut-off valve 37. As the carburetor throttle 29 approaches a fully opened position, such as during rapid acceleration or high engine speed, then the pressure of the intake manifold 19 and therefore the signal to the fluidic NOR gate 67 decreases toward atmospheric pressure, and when the vacuum signal is sufficiently reduced, then the air stream in the fluidic NOR gate 67 returns to the channel 77 for venting into the atmosphere, thereby closing the shut-off valve 37 to prevent the recirculation of exhaust gas.

To effect closing of the shut-off valve 37 at a predetermined engine speed, such as corresponding to 55 mph, the fluidic NOR gate 67 is provided with another control signal which is indicative of engine speed for deflecting the stream of air to the channel 77 leading to the outlet 79 to remove the positive digital air signal from the shut-off valve 37. As shown, the control signal indicative of engine speed is obtained from the air pump 73 which may be of a suitable vane type driven by fan belts of the engine 13 to provide a supply of air pressures corresponding to the engine speed, and a portion of the air flow provided by the air pump 73 is also supplied to another control port 85 through a control passageway 87 having a suitable restriction 89. When the engine reaches a predetermined speed, the control signal will normally deflect the air stream into the channel 77 for venting into the atmosphere, and in the absence of a positive digital air signal the shut-off valve 37 will close to prevent the recirculation of exhaust gas.

Figure 5:
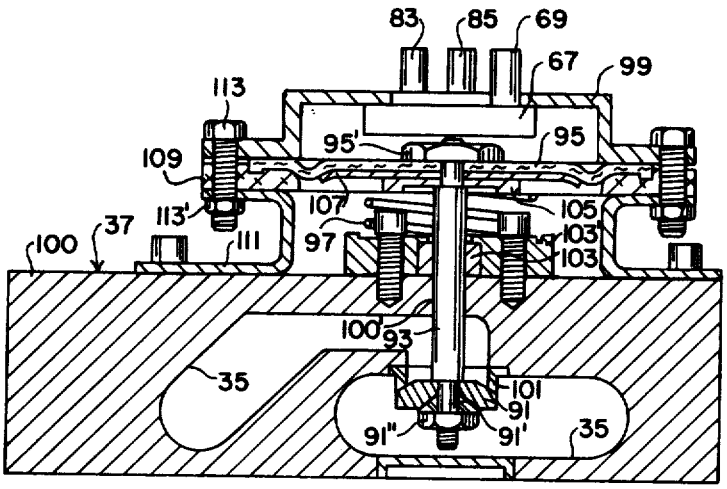
FIG. 5 is a cross-sectional view of the shut-off valve shown schematically in FIG. 4 along with the associated fluidic NOR gate.
Figure 6:
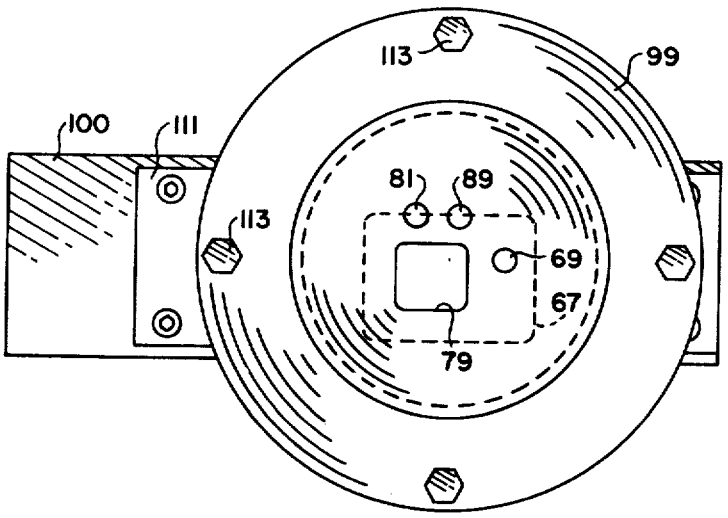
FIG. 6 is a top view of the shut-off valve and the fluidic NOR gate of FIG. 5.

As discussed above, the shut-off valve 37 is opened or closed in accordance with the presence of absence of a digital air signal from the fluidic NOR gate 67, and as shown in FIGS. 5 and 6 the fluidic NOR gate 67 may be mounted with the shut-off valve 37 for assembly as a unit with other components of the emission control system 11. The shut-off valve 37 is in the form of a valve member 91 carried on one end of a valve stem 93 while the other end is fastened to a diaphragm 95, and the shut-off valve 37 is normally biased to a closed position by a spring 97 pressing against a side of the diaphgram 95. The fluidic NOR gate 67 is mounted on a cover member 99 which is secured over another side of the diaphgram 95 opposite the spring 97 to form a closed chamber, and when the fluidic NOR gate 67 responds to a control signal causing the air stream to pass along the channel 75 leading to the shut-off valve 37 then the positive digital air signal will be supplied inside the cover member 99 causing the diaphgram 95 to move against the urging of the spring 97 to open the shut-off valve 37. Although the shut-off valve 37 is described as being a plunger type of valve, still other types of valves may be used, such as a spool type.

As more particularly shown in FIGS. 5 and 6, the shut-off valve 37 is located in a portion of the recirculation passageway 35 which may be formed in a housing 100 having overlapping portions of the recirculation passgeway 35 which are interconnected by an opening having a valve seat 101 for receiving the valve member 91. The valve member 91 has a generally conical configuration with an axial bore 91' through which a reduced threaded end portion of the valve stem 93 is received, and the valve member 91 is secured onto the valve stem 93 by a threaded nut 91". The valve stem 93 extends upwardly through the valve seat 101 and a bore 100' in the housing member 100 and a ring-shaped seal 103 which is clamped against the housing 100 by a bracket 103' bolted to housing 100. The other end of the valve stem 93 also has a reduced threaded end portion which is received through an axial opening formed in a spring guide 105 and a supporting disc 107 on one side of the diaphgram 95 which is secured to the threaded end portion of the valve stem 93 by a threaded nut 95'. The rim of the diaphgram 95 is carried on a ring 109 supported by a bracket 111 which is bolted to the housing 100, and the cover member 99 is clamped in air sealing relation to the diaphgram 95 by a plurality of threaded bolts 113 which are received through openings in the bracket 111 and fastened by threaded nuts 113'. The valve member 91 is normally pressed against the valve seat 101 in a closed position by the spring 97 which is coiled around the valve stem 93 and the spring guide 105 and is compressed between the bracket 103' and the diaphragm 95. Inside the closed chamber formed by the diaphragm 95 and the cover member 99, the fluidic NOR gate 67 is mounted to the cover member 99 in a suitable manner with the channel 75 opening inside the closed chamber to effect movement of the diaphragm 95 while the other channel 77 leads to a central opening 79 in the cover member 99 which serves as the outlet for venting the air stream into the atmosphere. The other ports of the fluidic NOR gate 67 open to corresponding connection tubes 69, 83 and 85 which open externally of the closed chamber.

The cover member 99 may be constructed from a suitable plastic material, such as polyester thermoplastic, and formed integrally with the connection tubes 69, 83 and 85. The valve member 91 and the valve seat 101 as well as the valve stem 93 and the associated threaded nuts 91" may be constructed from stainless steel while the diaphgram 95 may be constructed from a suitable silicone rubber. The seal 103 for the valve stem 93 may be constructed of a suitable carbon graphite, and the brackets 103' and 111 may be formed from steel. The housing 100 may be constructed from cast iron or steel and may be formed integrally with the plate 40 of the fluidic amplifier 39.

Figure 7:
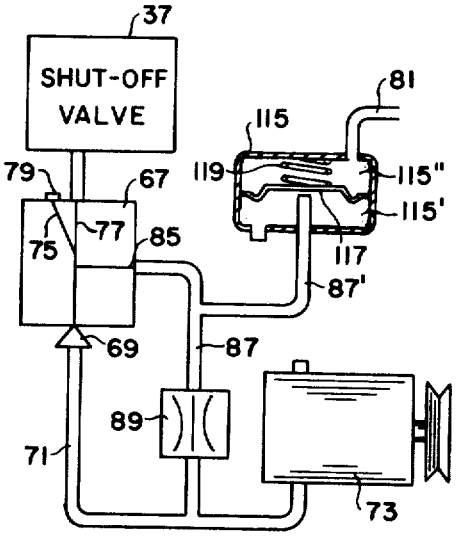
FIG. 7 is a modification of the illustration of FIG. 4 with the fluidic NOR gate controlling the shut-off valve in accordance with a positive air pressure signal which is indicative of the position of the carburetor throttle.

As discussed above, the shut-off valve 37 is provided with a digital air signal from the fluidic NOR gate 67 in accordance with the position of the carburetor throttle 29 in response to a negative vacuum signal obtained from a vacuum port located above the throttle 29 of the carburetor 27. In an alternative embodiment as shown in FIG. 7, the vacuum signal from the carburetor 27 is transformed into a positive air signal for operating the fluidic NOR gate 67. As in the previous embodiment of FIG. 4, the fluidic NOR gate 67 may be supplied with an air flow from a suitable air supply means, such as the air pump 73, however contrary to the previous embodiment of FIG. 4 the channel 77 leads to the closed chamber of the shut-off valve 37 while the channel 75 leads to an outlet 79' for venting the air flow into the atmosphere. To convert the vacuum signal from the carburetor 27 to a positive air signal, a portion of the air flow provided by the air pump 73 is supplied to the control port 85 by a passageway 87 providing a suitable restriction 89 and having a vent portion 87' leading into a housing 115 which is open to atmospheric pressure and terminating adjacent a diaphragm 117 which is secured in air sealing relation to the housing 115 to form a vacuum chamber, generally indicated 115".

To prevent the shut-off valve 37 from opening during engine idling speeds, the diaphragm 117 is normally pressed against the open end of the vent portion 87' of the passageway 87 under the urging of a spring 119 which may be disposed in the vacuum chamber 115" of the housing 115 thereby enabling a positive air signal to be supplied to the control port 85. However, to vary the positive air signal in accordance with the movement of the carburetor throttle 27, the vacuum chamber 115" is connected by the vacuum passageway 81 to the vacuum port just above the throttle 29 of the carburetor 27, and as the throttle 29 is opened a negative vacuum signal is communicated to the vacuum chamber 115" to move the diaphragm 117 against the urging of the spring 119 and gradually vent the control signal into the atmosphere, thereby enabling the air stream in the fluidic NOR gate 67 to switch to the channel 77 to effect opening of the shut-off valve 37 as previously explained. As the carburetor throttle 29 is moved further toward a fully open position, the pressure in the intake manifold 25 approaches atmospheric pressure causing the vacuum signal to diminish thereby enabling the spring 119 to move the diaphragm 117 against the vent portion 87' of the passageway 87 to again cause the air signal to be supplied to the control port 81 to switch the air stream in the fluidic NOR gate 67 and effect closing of the shut-off valve 37.

Figure 8:
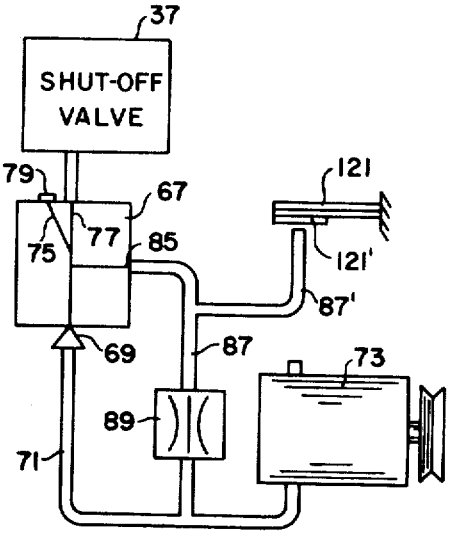
FIG. 8 is a diagrammatic illustration of the fluidic NOR gate of FIG. 4 controlling the shut-off valve in accordance with engine temperature.

In addition, it may be desirable to prevent recirculation of the exhaust gas following the starting of the engine 13 until it achieves a desirable operating temperature. As discussed above in connection with FIG. 7 the opening and closing of the shut-off valve 37 may be affected by varying the air signal supplied to the control jet 85 of the fluidic NOR gate 67, and to control the recirculation of the exhaust gas in accordance with the temperature of the engine 13, the air signal may be varied by means of temperature sensor in the form of a suitable bimetallic element 121 as shown in FIG. 8. As previously discussed, the fluidic NOR gate 67 is supplied with air from a suitable air supply means, and the control port 85 is provided with an air signal by the passageway 87 providing a suitable restriction 89 and having a vent portion 87' which opens to atmospheric pressure. When the engine 13 is below a desirable operating temperature the vent portion 87' of the passageway 87 is normally closed by a valve member 121' carried by the bimetallic element 121 thereby switching the air stream of the fluidic NOR gate 67 to the channel 75 for venting into the atmosphere to keep the shut-off valve 37 closed. The bimetallic element 121 response to the temperature of the engine 13, and as the temperature increases to a desirable operating temperature, the bimetallic element 121 moves the valve member 121 from the vent portion 87' of the passageway 87 thereby removing the air signal from the control port 85 to switch the air stream to the channel 75 leading to the shut-off valve 37 causing it to open and permit recirculation of the exhaust gas through the engine 13 in the manner previously explained.

Although not shown, the temperature responsive feature of FIG. 8 may be combined with the fluidic NOR gate arrangement of FIG. 7 so as to provide an air signal to the control port 85 which is responsive to both the temperature of the engine 13 as well as the position of the throttle 29 of the carburetor 27. Moreover, the temperature responsive feature of FIG. 8 may be combined with the arrangement shown in FIG. 4 wherein the fluidic NOR gate 67 is operated directly in response to a negative vacuum signal from the carburetor 27 instead of being converted into a positive air pressure signal in the manner shown in FIG. 7. In such an arrangement, the vacuum passageway 81 leading from the carburetor 27 to the control port 89 would be provided with a vent portion operably associated with a vale member 121' movable with a bimetallic member 121 responding to the temperature of the engine 13. Accordingly when the temperature of the engine 13 is below a desirable operating temperature, the vent portion would be opened to prevent a vacuum air signal from operating the fluidic NOR gate 67 to open the shut-off valve 37, but when the temperature of the engine increases to a desirable operating temperature, then the bimetallic element 121 would close the vent portion, thereby enabling the vacuum signal from the carburetor 27 to operate the fluidic NOR gate 67 in the manner previously described in connection with FIG. 4.

In addition, it may be desirable to modulate the flow of recirculating exhaust gas through the engine 13 in response to changing driving conditions such as variations in air density. The movement of an automobile from a lower altitude, such as sea level, to a higher altitude, such as in the mountains, is accompanied by a decrease in the atmospheric pressure which reduces the back pressure of the engine 13 and thereby causing less exhaust gas to flow through the fluidic amplifier 39 and at the same time increasing the relative effectiveness of the control signal provided by the vacuum pressure of the intake manifold 19 so as to reduce the amount of exhaust gas recirculated through the engine 13. In accordance with another aspect of the present invention, the control signal operating the fluidic amplifier 39 may be compensated for changes in air density by means of an air density sensor generally indicated 123.

Figure 9:
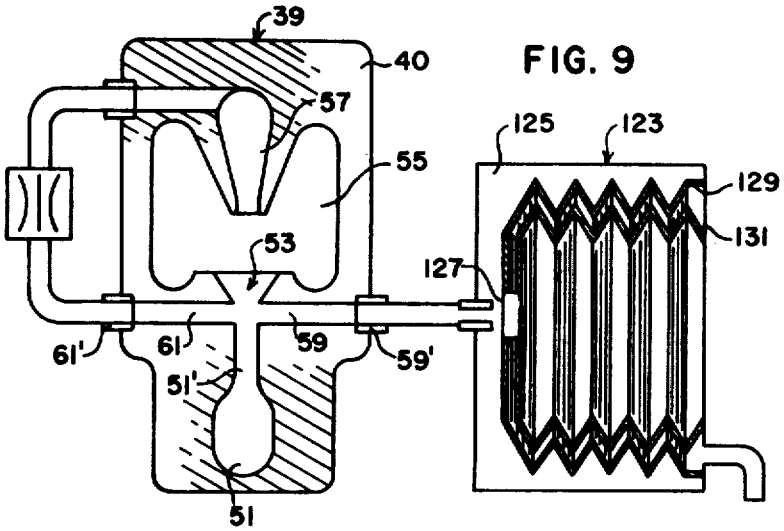
FIG. 9 is a diagrammatic illustration of the fluidic amplifier of FIG. 1 arranged in a manner to compensate for changes in air density.

As more particularly shown in FIG. 9, the air density sensor 123 is associated with the control port 59' which opens to atmospheric pressure in a housing 125, and the air density sensor 123 includes a valve member 127 which is movable relative to the control port 59' for restricting flow of air into the control jet 59 in response to variations in air density. As shown, the valve member 127 is mounted on a pair of inner and outer concentric bellows 129, 131 respectively which are normally resilient to an expanded position with the inner bellows sealed from the atmosphere while the intermediate space between the pair of bellows 129, 131 is vented to atmospheric pressure. When the air density decreases, such as during movement to a higher altitude, the bellows 128, 131 expand and move the valve member 127 to close the control port 59'. As the beam of exhaust gas passes by the control jet 59, there is normally an entrainment of air from the control jet 59, but when the control jet 59 is closed to atmospheric pressure the passing beam of exhaust gas creates a vacuum pressure which reduces the effect of the feedback signal at the control jet 61 so as to increase the exhaust gas recirculated to the engine 13. Conversely, as the air density increases such as during movement to a lower altitude, the bellows 129, 131 contract and move the valve member 127 from the control port 59', thereby reducing the restriction and decreasing the force exerted on the beam of exhaust gas to enable the deflection of the beam to be determined by the vacuum signal of the control jet 61. Although the air density sensor 123 is shown in the form of a valve 127 associated with a pair of bellows 129, 131, it is to be understood that other devices responsive to variations in air density may be utilized to provide a restriction for the control jet 59.

Figure 10:
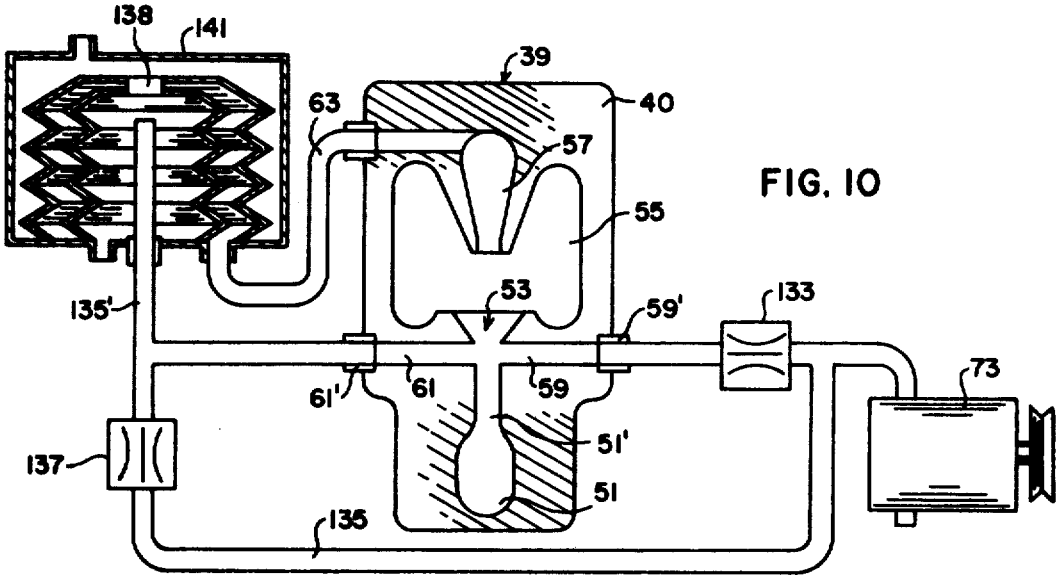
FIG. 10 is a diagrammatic illustration of the fluidic amplifier of FIG. 1 arranged to vary the flow of recirculating exhaust gas in response to variations in engine speed.

In addition, it may also be desirable to vary the quantity of exhaust gas recirculating through the engine 13 in accordance with the engine speed since the volume or mass of the combustible air fuel mixture which passes through the engine 13 becomes greater with increasing speeds. In accordance with still another aspect of the invention the deflection of the beam of exhaust gas passing through the fluidic amplifier 39 may be varied by providing the control jet 59 with an air signal varying in pressure in accordance with the speed of the engine 13. As previously discussed, an air signal which is representative of the speed of the engine 13 may be obtained from a suitable air pump 73 driven by the fan belts of the engine 13, and as more particularly shown in FIG. 10 the air signal may be supplied to the control jet 59 of the fluidic amplifier 39 through a passageway 133 providing a suitable restriction 133'. The other control jet 61 may be provided with a positive air signal corresponding to the vacuum pressure of the intake manifold 19 by connecting the control jet 61 to the air pump 73 through a passageway 135 providing a suitable restriction 137 and having a vent portion 135' extending into a housing 141 and opening to atmospheric pressure adjacent a valve member 138. The valve member 138 is movably associated with a pair of inner and outer concentric bellows 140, 142 respectively, which are normally resilient to an expanded position and are connected in air sealing relation to the valve member 138 and the housing 141. The space between the bellows 140, 142 is exposed to the vacuum pressure of the intake manifold 19 through the feedback passageway 63 while the space within the inner bellows 140 is open to atmospheric pressure.

When the vacuum pressure of the intake manifold is relatively high, the bellows 140, 142 contract to close the vent portion 135' with the valve member 138, thereby supplying an air signal to the control jet 61. Since the restriction 137 is less than the restriction 133', the resulting differential pressure on the beam of exhaust gas passing through the fluidic amplifier 39 deflects it toward the vent chamber 55. As the throttle 29 is moved to an open position, the vacuum pressure of the intake manifold 19 is reduced enabling the resilient bellows 140, 142 to move the valve member 138 from the vent portion 135', thereby diminishing the air signal supplied to the control jet 61 and reducing the deflection of the beam of exhaust gas so as to increase the amount of exhaust gas recirculated through the engine 13. At the same time, when the speed of the engine 13 increases, the increasing pressure of the air signal supplied to the control jet 59 reduces the effect of the air signal supplied to the control jet 61 and even reverses the differential pressure on the beam of exhaust gas to deflect it in an opposite direction thereby diminishing the flow of recirculating exhaust gas through the engine 13.

Figure 11:
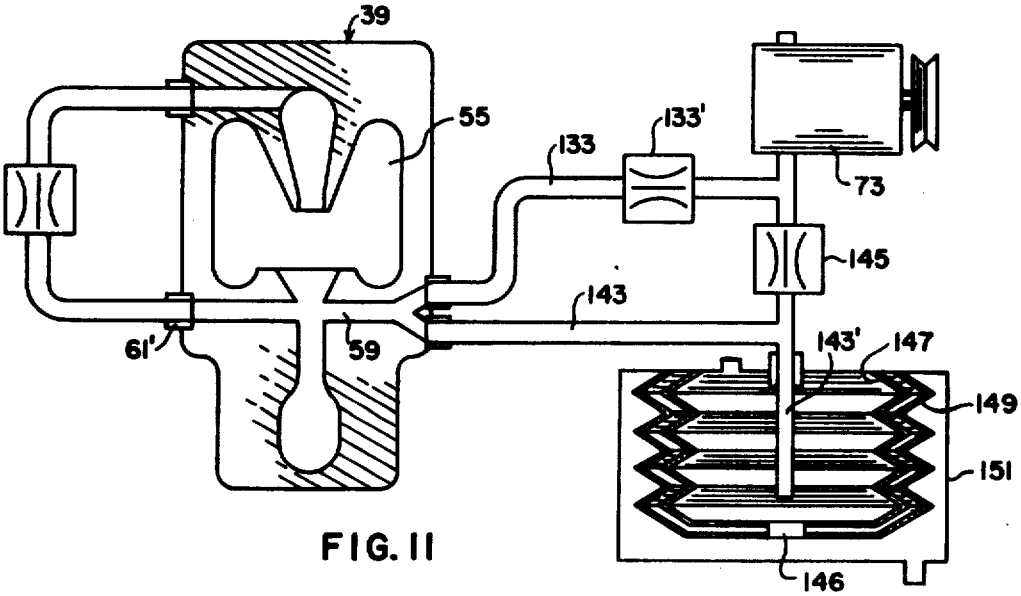
FIG. 11 is a diagrammatic illustration of the fluidic amplifier of FIG. 10 arranged for operation in response to variations in engine speed as well as air density.

Furthermore, the flow of recirculating exhaust gas may be varied in accordance with both the speed of the engine 13 and variations in air density. As more particularly shown in FIG. 11, the control jet 61 is provided with a vacuum signal from the intake manifold 19 of the engine 13 while the control jet 59 may be provided with an air signal indicative of the speed of the engine 13 by the use of a suitable air pump 73 as described in the preceeding arrangement shown in FIG. 10. To vary the air signal supplied to the control jet 59 in accordance with the changes in air density, the control jet 59 is provided with another passageway 143 which is connected to the pump 73 through a suitable restriction 145, and the passageway is provided with a vent portion 143' which opens to atmospheric pressure adjacent a valve 146. The valve 146 is movably associated with a pair of inner and outer concentric bellows 147, 149 respectively which are normally resilient to an expanded position and are mounted in a housing 151 with the space between the inner and outer bellows 147 and 149 being sealed from atmospheric pressure while the space within the inner bellows 147 is open to atmospheric pressure.

As in the preceeding arrangements, when the vacuum pressure of the intake manifold is relatively high the beam of exhaust gas is deflected toward the vent chamber 55 to reduce the flow of recirculating exhaust gas through the engine, and as the carburetor throttle 29 is moved to an open position the vacuum signal is reduced, thereby diminishing the deflection of the beam of exhaust gas to increase the flow of exhaust gas recirculated through the engine 13. As the engine speed increases, the back pressure also increases to provide a greater flow of exhaust gas passing through the fluidic amplifier 39, and at the same time the air signal supplied to the control jet 59 increases to deflect the beam of exhaust gas toward the vent chamber 55 reducing the exhaust gas recirculated to the engine 13. As previously discussed, the deflection of the beam of exhaust gas is normally determined by the differential pressure between the control jets 59 and 61 and at relatively low altitudes the bellows 147, 149 contract and the valve member 146 closes the vent portion 143' of the passageway 143 so that an air signal is supplied to the control jet 59. During movement to a higher altitude, the air density decreases and the resilient bellows 147, 149 expand to reduce the restriction provided by the valve member 146, thereby diminishing the air signal provided through the passageway 143 to compensate for the increasing effectiveness of the vacuum signal supplied to the control port 61.

It may also be desirable to modulate the flow of recirculating exhaust gas in accordance with a vacuum signal from the carburetor 27 instead of from the intake manifold 19, and the invention as described in the preceeding arrangements may be easily modified to accomplish this different mode of operation. As more particularly shown in FIG. 12, the fluidic amplifier 29 is arranged in generally the same manneer as in the preceeding embodiments with the recirculation passageway 35 connecting the exhaust manifold 25 to the supply port 41 and the outlet port 43 through the shut-off valve 37 to the intake manifold 19. The vent port 45 is connected by the vent passageway 47 to a relatively low pressure as provided by means in the form of the venturi 49 disposed in the exhaust manifold 25 so as to create a pressure differential between the supply port 41 and the exhaust port 43 thereby forming a high velocity stream of recirculating exhaust gas through the fluidic amplifier in the manner previously described which varies in accordance with the back pressure of the exhaust manifold 25. To modulate the flow of recirculating exhaust gas in accordance with a vacuum signal from the carburetor, the control port 61' is connected to a port in the carburetor 27 through a passageway 64.

The flow of exhaust gas through the recirculation passageway 35 will be prevented until the shut-off valve 37 is opened in the manner previously described, and as a flow of recirculating exhaust gas passes through the fluidic amplifier 39, it will be modulated by a signal from the carburetor 27 which varies in accordance with the opening of the throttle 29. As previously described in connection with the operation of the fluidic NOR gate 67, the carburetor 27 will be at atmospheric pressure when the throttle 29 is in a closed position. However, as the throttle 29 is opened the air passing through the carburetor 27 into the intake manifold 19 will create a vacuum signal which will be applied through the passageway 64 to the fluidic amplifier 39 creating a differential pressure across the beam of exhaust gas which forces it toward the vent chamber 55, thereby reducing the flow of recirculating exhaust gas to the engine 13. As the throttle 29 continues to move toward an open position, the vacuum signal from the carburetor 27 diminishes and enables a greater portion of the recirculating exhaust gas to pass through the engine 13.

Alternatively, it may be desirable to vary the supply of exhaust gas to the fluidic amplifier 39 in accordance with the speed of the engine 13 while at the same time modulating the flow of recirculating exhaust gas in accordance with the back pressure of the exhaust manifold 25, and the invention as discussed above may be modified to accomplish still another mode of operation. As more particularly shown in FIG. 13, this further arrangement is generally similar to the arrangement shown in FIG. 1, however instead of the supply port 41 of the fluidic amplifier 39 being connected by the recirculation passageway 35 the exhaust manifold 25, it is connected to an outlet port 143' of a suitable pump 143 having an inlet port 143" connected downstream of the muffler 31. The pump 143 may be driven by the fan belts of the engine 13 so as to supply exhaust gas to the fluidic amplifier 39 in accordance with the speed of the engine, and the flow of recirculating exhaust gas through the fluidic amplifier 39 may be further modulated by connecting the control port 59' to the exhaust manifold 25 upstream of the muffler 31. Accordingly, the amount of recirculating exhaust gas supplied to the fluidic amplifier will vary in accordance with the speed of the engine 13 with greater quantities of exhaust gas being supplied as the engine accelerates. Moreover, the flow of recirculating exhaust gas through the fluidic amplifier will be modulated in accordance with the back pressure of the exhaust manifold 25 and the vacuum pressure of the intake manifold 19 creating differential pressure across the beam of recirculating exhaust gas which will deflect the beam of recirculating exhaust gas toward the vent chamber 55 as described above in connection with the preceeding arrangements.

What is claimed is:

1. An emission control system for an internal combustion engine, the combination comprising:

a fluidic amplifier having a supply port and an outlet port, a recirculation passageway for connecting the supply port of said fluidic amplifier to a source of exhaust gas having a pressure variable in accordance with the operation of the internal combustion engine and for connecting the outlet port to an intake manifold for recirculating exhaust gas through the engine, said fluidic amplifier having a power jet chamber in fluid communication with the supply port and a receiver chamber in fluid communication with the outlet port, said fluidic amplifier having wall means defining an intermediate space between a receiver chamber and the power jet chamber with the nozzle portion of the power jet chamber directed toward the receiver chamber, said fluidic amplifier having a vent chamber opening into the intermediate space and in fluid communication with a vent port for venting to a relatively low fluid pressure so as to create a differential pressure with the power jet chamber to form a relatively high velocity stream of recirculating exhaust gas acting as a beam for passage through the intermediate space to the receiver chamber with the amount of recirculated exhaust gas varying in accordance with the pressure of the exhaust gas supplied to the supply port, low pressure means for generating a low pressure relative to the pressure of the exhaust gas being supplied to the inlet port of said fluidic amplifier, said low pressure means being in the form of a venturi disposed in the exhaust system of the internal combustion engine, and a vent passageway connecting the vent port of said fluidic amplifier to said low pressure means.

2. An emission control system for an internal combustion engine, the combination comprising:

a fluidic amplifier having a supply port and an outlet port, a recirculation passageway for connecting the supply port of said fluidic amplifier to a source of exhaust gas having a pressure variable in accordance with the operation of the internal combustion engine and for connecting the outlet port to an intake manifold for recirculating exhaust gas through the engine, said recirculation passageway connecting the supply port of said fluidic amplifier to the exhaust system of the internal combustion engine, said fluidic amplifier having a power jet chamber in fluid communication with the supply port and a receiver chamber in fluid communication with the outlet port, said fluidic amplifier having wall means defining an intermediate space between a receiver chamber and the power jet chamber with the nozzle portion of the power jet chamber directed toward the receiver chamber, said fluidic amplifier having a vent chamber opening into the intermediate space and in fluid communication with a vent port for venting to a relatively low fluid pressure so as to create a differential pressure with the power jet chamber to form a relatively high velocity stream of recirculating exhaust gas acting as a beam for passage through the intermediate space to the receiver chamber with the amount of recirculated exhaust gas varying in accordance with the pressure of the exhaust gas supplied to the supply port, a venturi disposed in the exhaust system of the internal combustion engine, and a vent passageway connecting the vent port of said fluidic amplifier to said venturi.

3. An emission control system for an internal combustion engine, the combination comprising:

a fluidic amplifier having a supply port and an outlet port, a recirculation passageway for connecting the supply port of said fluidic amplifier to a source of exhaust gas having a pressure variable in accordance with the operation of the internal combustion engine and for connecting the outlet port to an intake manifold for recirculating exhaust gas through the engine, said fluidic amplifier having a power jet chamber in fluid communication with the supply port and a receiver chamber in fluid communication with the outlet port, said fluidic amplifier having wall means defining an intermediate space between a receiver chamber and the power jet chamber with the nozzle portion of the power jet chamber directed toward the receiver chamber, said fluidic amplifier having a vent chamber opening into the intermediate space and in fluid communication with a vent port for venting to a relatively low fluid pressure so as to create a differential pressure with the power jet chamber to form a relatively high velocity stream of recirculating exhaust gas acting as a beam for passage through the intermediate space to the receiver chamber with the amount of recirculated exhaust gas varying in accordance with the pressure of the exhaust gas supplied to the supply port, valve means operable in response to air signals for controlling the flow of exhaust gas from the outlet port of said fluidic amplifier through the recirculating passageway, and control means operable in response to selected operating conditions of the internal combustion engine for supplying a digital air signal to said valve means to effect opening of the recirculation passageway to the flow of exhasut gas.

4. In an emission control system for an internal combustion engine, the combination comprising:

a passageway for recirculating exhaust gas to an intake manifold of the internal combustion engine, valve means operable in response to air signals for opening or closing to control the flow of recirculating exhaust gas through said passageway, control means operable in response to selected operating conditions of the internal combustion engine for supplying a digital air signal to said valve means to effect opening of said passageway to the flow of recirculating exhaust gas, said valve means including a valve member supported for movement in the recirculation passageway relative to a valve seat, a closed chamber in fluid communication with said control means for receiving digital air signals and being partially formed by a diaphragm movably associated with said valve member, resilient biasing means urging said diaphragm in a direction to close the valve member against the valve seat in the recirculation passageway, said control means being in the form of a fluidic NOR gate operable in response to analog signals representative of selected engine operating conditions for supplying digital air signals to the closed chamber of said valve means to effect movement of the valve member, said fluidic NOR gate having a supply port for receiving a supply of compressed air to provide an air stream therethrough and a first channel leading from the supply port to an outlet port open to the atmosphere for normally venting an air stream received through the supply port, said fluidic NOR gate having a second channel leading from the first channel and being in fluid communication with the closed chamber of said valve means, and said fluidic NOR gate having a control jet in fluid communication with the carburetor for enabling a vacuum signal indicative of a predetermined air flow through the carburetor to effect switching of the air stream from the first channel to the second channel for opening said valve means.

5. In an emission control system according to claim 1, the combination further comprising:

a pump having inlet and outlet ports, said recirculation passageway connecting the outlet port of said pump to the supply port of said fluidic amplifier and connecting the inlet port of said air pump to a supply of exhaust gas at substantially atmospheric pressure, and said pump being operable in response to the operation of the internal combustion engine for supplying exhaust gas to the supply port of said fluidic amplifier at pressures corresponding to the speed of the engine.

6. An emission control system according to claim 5, the combination further comprising:

a venturi disposed in the exhaust manifold of the internal combustion engine, and a vent passageway connecting the vent port of said fluidic amplifier to said venturi.

7. In an emission control system according to claim 6, the combination further comprising:

valve means operable in response to air signals controlling the flow of exhaust gas from the outlet port of said fluidic amplifier through the recirculating passageway, and control means operable in response to selected operating conditions of the internal combustion engine for supplying a digital air signal to said valve means to effect opening of the recirculation passageway to the flow of exhaust gas.

8. In an emission control system according to claim 1, said fluidic amplifier having wall means defining first and second control jets on laterally opposite sides of the nozzle portion of said power jet chamber and adjacent the intermediate space for enabling fluid control signals to create a differential pressure exerting a force on the beam of exhaust gas passing into the intermediate space for deflecting it toward the vent chamber.

9. In an emission control system according to claim 8:

said first control jet being in fluid communication with an atmospheric pressure, and a feedback passageway providing fluid communication between the intake manifold of the internal combustion engine and said second control jet of said fluidic amplifier to create a differential pressure effecting deflection of the beam of recirculating exhaust gas in accordance with variations in the vacuum pressure of the intake manifold.

10. In an emission control system according to claim 9, the combination further comprising:

a pump having inlet and outlet ports, said recirculation passageway connecting the outlet port of said pump to the supply port of said fluidic amplifier and connecting the inlet port of said pump to a supply of exhaust gas at substantially atmospheric pressure, and said pump being operable in response to the operation of the internal combustion engine for supplying exhaust gas to the supply port of said fluidic amplifier at pressures corresponding to the speed of the engine.

11. An emission control system according to claim 10, the combination further comprising:

a venturi disposed in the exhaust manifold of the internal combustion engine, and a vent passageway connecting the vent port of said fluidic amplifier to said venturi.

12. In an emission control system according to claim 11, the combination further comprising:

valve means operable in response to selected operating conditions of the internal combustion engine for preventing a flow of recirculation of exhaust gas through the outlet port of said fluidic amplifier and closing the fluid communication between the intake manifold of the internal combustion engine and the second control jet of said fluidic amplifier.

13. In an emission control system according to claim 9, said recirculation passageway connecting the supply port of said fluidic amplifier to an exhaust manifold of the internal combustion engine.

14. In an emission control system according to claim 13, the combination further comprising:

valve means operable in response to selected operating conditions of the internal combustion engine for preventing a flow of recirculating exhaust gas through the outlet port of said fluidic amplifier and closing the fluid communication between the intake manifold of the internal combustion engine and the second control jet of said fluidic amplifier.

15. In a emission control system according to claim 8:

said first control jet being in fluid communication with an atmospheric pressure, and a passageway providing fluid communication between a carburetor and said second control jet to create a differential pressure effecting deflection of the beam of recirculating exhaust gas in accordance with variations in the air flow through the carburetor.

16. In an emission control system according to claim 15, said recirculation passageway connecting the supply port of said fluidic amplifier to an exhaust manifild of the internal combustion engine.

17. An emission control system according to claim 16, the combination further comprising:

a venturi disposed in the exhaust manifold of the internal combustion engine, and a vent passageway connecting the vent port of said fluidic amplifier to said venturi.

18. In an emission control system according to claim 17, the combination further comprising:

valve means operable in response to air signals controlling the flow of exhaust gas from the outlet port of said fluidic amplifier through the recirculating passageway, and control means operable in response to selected operating conditions of the internal combustion engine for supplying a digital air signal to said valve means to effect opening of the recirculation passageway to the flow of exhaust gas.

19. In an emission control system according to claim 18, valve means comprising:

a valve member supported for movement in the recirculation passageway relative to a valve seat, a closed chamber in fluid communication with said control means for receiving digital air signals and being partially formed by a diaphragm movably associated with said valve member, and resilient biasing means urging said diaphragm in a direction to close the valve member against the valve seat in the recirculation passageway.

20. In an emission control system according to claim 19, said control means being in the form of a fluidic NOR gate operable in response to analog signals representative of selected engine operating conditions for supplying digital air signals to the closed chamber of said valve means to effect movement of the valve member.

21. In an emission control system according to claim 20, the combination further comprising:

an air pump driven by the internal combustion engine and having an outlet for supply air at a pressure corresponding to the speed of the engine, said fluidic NOR gate having supply port in fluid communication with the outlet of said air pump for providing an air stream therethrough and a first channel leading from the supply port to an outlet port open to the atmosphere for normally venting the air stream.

said fluidic NOR gate having a second channel leading from the first channel and being the fluid communication with the closed chamber of said valve means, and said fluidic NOR gate having a control jet in fluid communication with the outlet of said air pump for enabling a positive air signal indicative of a predetermined engine speed to effect switching of the air stream from the second channel to the first channel for closing said valve means.

22. In an emission control system according to claim 8:

said first control jet being in fluid communication with a port opening to atmospheric pressure, and air density sensor means providing a restriction to the flow of air into said first control jet of said fluidic amplifier which varies in response to changes in the atmospheric density.

23. In an emission control system according to claim 22, said air density sensor means comprising:

a valve member for restricting the opening of the control jet port, and bellows means carrying said valve member and being movable relative to the control jet port in response to variation in air density.

24. An emission control system according to claim 23, wherein said bellows means includes inner and outer concentrically arranged bellows with the inner bellows sealed against atmospheric pressure and with the space between the inner and outer bellows being open to atmospheric pressure.

25. In an emission control system according to claim 8, the combination further comprising:

speed signal means responsive to the speed of the internal combustion engine for supplying corresponding positive air signals to the first control jet of said fluidic amplifier, and vacuum signal means responsive to changes in the vacuum pressure of the intake manifold for supplying corresponding positive air signals to the second control jet of said fluidic amplifier.

26. An emission control system according to claim 25, wherein said speed signal means comprises:

an air pump driven by the internal combustion engine and having an outlet for supplying air at pressure corresponding to the speed of the engine, and a first passageway connecting the first control jet of said fluidic amplifier to the outlet of said air pump.

27. An emission system according to claim 26, wherein said vacuum signal means comprises:

a second passageway connecting the second control jet of the fluidic amplifier to the outlet of said air pump and having a vent portion open to atmospheric pressure, a valve member for restricting the flow of air from the vent portion of said second passageway, bellow means carrying said valve member and including inner and outer concentrically arranged bellows with the space between the bellows being sealed against the atmosphere, and a vacuum passageway providing fluid communication between the intake manifold of the internal combustion engine and the space between the inner and outer bellows for effecting movement of said bellow means in response to variations in the vacuum pressure of the intake manifold.

28. In an emission control system according to claim 25, said vacuum signal means comprising:

a source of compressed air, a passageway providing fluid communication between the second control jet and said source of compressed air and having a vent portion open to atmospheric pressure, a valve member for restricting the flow of air from the vent portion of said second passageway, bellows means carrying said valve member and including inner and outer concentrically arranged bellows with the space between the bellows being sealed against the atmosphere, and a vacuum passageway providing fluid communication between the intake manifold of the internal combustion engine and the space between the inner and outer bellows for effecting movement of said bellows means in response to variations in the vacuum pressure of the intake manifold.

29. In an emission control system accordingly to claim 8:

an air pump driven by the internal combustion engine and having an outlet for supplying air at pressures corresponding to the speed of the engine, a first passageway providing fluid communication between the outlet of said air pump and the first control jet and having a vent portion open to atmospheric pressure, and air density sensor means providing a restriction to the flow of air from the vent portion of said second passageway which varies in response to changes in the atmospheric density.

30. In an emission control system according to claim 29, said air density sensor means comprising:

a valve member for restricting the flow of air from the vent portion of said second passageway, and bellows means carrying said valve member and being movable relative to the vent portion of said second passageway in response to variations in air density.

31. An emission control system according to claim 30, wherein said bellow means includes inner and outer concentrically arranged bellows with the space between the bellows being sealed against the atmosphere.

32. In an emission control system according to claim 2, the combination further comprising:

valve means operable in response to air signals for controlling the flow of exhaust gas from the outlet port of said fluidic amplifier through the recirculation passageway, and control means operable in response to selected operating conditions of the internal combustion engine for supplying a digital air signal to said valve means to effect opening of the recirculation passageway to the flow of exhaust gas.

33. In an emission control system according to claim 16, the combination further comprising:

an air pump driven by the internal combustion engine and having an outlet for supplying air at a pressure corresponding to the speed of the engine, said fluidic NOR gate having a supply port in fluid communication with the outlet of said air pump for providing an air stream therethrough and a first channel leading from the supply port to an outlet port open to the atmosphere for normally venting the air stream, said fluidic NOR gate having a second channel leading from the first channel and being in fluid communication with the closed chamber of said valve means, and said fluidic NOR gate having a control jet in fluid communication with the outlet of said air pump for enabling a positive air signal indicative of a predetermined engine speed to effect switching of the air stream from the second channel to the first channel for closing said valve means.

34. In an emission control system according to claim 3, valve means comprising:

a valve member supported for movement in the recirculation passageway relative to a valve seat, a closed chamber in fluid communication with said control means for receiving digital air signals and being partially formed by a diaphragm movably associated with said valve member, and resilient biasing means urging said diaphragm in a direction to close the valve member against the valve seat in the recirculation passageway.

35. In an emission control system according to claim 34, said control means being in the form of a fluidic NOR gate operable in response to analog signals representative of selected engine operating conditions for supplying digital air signals to the closed chamber of said valve means to effect movement of the valve member.

36. In an emission control system according to claim 35:

said fluidic NOR gate having a supply port for receiving a supply of compressed air to provide an air stream therethrough and a first channel leading from the supply port to an outlet port open to the atmosphere for normally venting an airstream received through the supply port, said fluidic NOR gate having a second channel leading from the first channel and being in fluid communication with the closed chamber of said valve means, and said fluidic NOR gate having a control jet in fluid communication with the carburetor for enabling a vacuum signal indicative of a predetermined air flow through the carburetor to effect switching of the air stream from the first channel to the second channel for opening said valve means.

37. In an emission control means according to claim 36, the combination further comprising:

an air pump driven by the internal combustion engine and having an outlet for supplying air at a pressure corresponding to the speed of the engine, and said fluidic NOR gate having a control jet in fluid communication with the outlet of said air pump for enabling a positive air signal indicative of a predetermined engine speed to effect switching of the air stream from the second channel to the first channel for closing said valve means.

38. In an emission control system according to claim 35, the combination further comprising:

air supply means for providing a supply of compressed air, said fluidic NOR gate having a supply port in fluid communication with said air supply means for providing a stream of air therethrough and a first channel leading from the supply port and being in fluid communication with the closed chamber of said valve means for normally providing a digital air signal to effect opening of said valve means, said fluidic NOR gate having a second channel leading from the first channel to an outlet port opening to the atmospheric pressure.

said fluidic NOR gate having a control jet for enabling an air signal to effect switching of the air stream from the first channel to the second channel, a passageway providing fluid communication between the control jet and air supply means and having a vent portion open to atmospheric pressure, a vacuum chamber formed partially by a diaphragm arranged for movement relative to the vent portion of said passageway for providing a restriction to the flow of air from the vent portion, resilient biasing means normally biasing the diaphragm against the vent portion of said passageway, and a vacuum passageway providing fluid communication between said vacuum chamber and the intake manifold of the internal combustion engine for effecting movement of the diaphragm in response to variations in the vacuum pressure of the intake manifold.

39. In an emission control system according to claim 35, the combination further comprising:

air supply means for providing a supply of compressed air, said fluidic NOR gate having a supply port in fluid communication with said air supply means for providing a stream of air therethrough and a first channel leading from the supply port and being in fluid communication with the closed chamber of said valve means for normally providing a digital air signal to effect opening of said valve means, said fluidic NOR gate having a control jet to effect switching of the air stream from the first channel to the second channel, a pasageway providing fluid communication between the control jet and said air supply means and having a vent portion open to atmospheric pressure, a valve member for restricting the flow of air from the vent portion of said passageway, and a bimetalic member connected to said valve member and responsive to variations in the temperature of the internal combustion engine for moving said valve member to close the vent portion of said passageway at a predetermined engine temperatures to effect closing of said valve means and being operable in response to engine temperatures greater than the predetermined engine temperature for moving said valve member to open the vent portion of said passageway to effect switching of the air stream from the second channel to the first channel to open said valve means.

40. In an emission control means according to claim 4, the combination further comprising:

an air pump driven by the internal combustion engine and having an outlet for supplying air at a pressure corresponding to the speed of the engine, and said fluidic NOR gate having a control jet in fluid communication with the outlet of said air pump for enabling a positive air signal indicative of a predetermined engine speed to effect switching of the air stream from the second channel to the first channel for closing said valve means.

41. In an emission control system according to claim 4, the combination further comprising:

an air pump driven by the internal combustion engine and having an outlet for supplying air at a pressure corresponding to the speed of the engine, said fluidic NOR gate having a supply port in fluid communication with the outlet of said air pump for providing an air stream therethrough and a first channel leading from the supply port to an outlet port open to the atmosphere for normally venting the air stream, said fluidic NOR gate having a second channel leading from the first channel and being in fluid communication with the closed chamber of said valve means, and said fluidic NOR gate having a control jet in fluid communication with the outlet of said air pump for enabling a positive air signal indicative of a predetermined engine speed to effect switching of the air stream from the second channel to the first channel for closing said valve means.

42. In an emission control system according to claim 4, the combination further comprising:

air supply means for providing a supply of compressed air, said fluidic NOR gate having a supply port in fluid communication with said air supply means for providing a stream of air therethrough and a first channel leading from the supply port and being in fluid communication with the closed chamber of said valve means for normally providing a digital air signal to effect opening of said valve means, said fluidic NOR gate having a control jet for enabling an air signal to effect switching of the air stream from the first channel to the second channel, a passageway providing fluid communication between the control jet and said air supply means and having a vent portion open to atmospheric pressure, a vacuum chamber formed partially by a diaphragm arranged for movement relative to the vent portion of said passageway for providing a restriction to the flow of air from the vent portion, resilient biasing means normally biasing the diaphragm against the vent portion of said passageway, and a vacuum passageway providing fluid communication between said vacuum chamber and the intake duct of the internal combustion engine for effecting movement of the diaphragm in response to variations in the vacuum pressure of the intake manifold.

43. In an emission control system according to claim 4, the combination further comprising:

air supply means for providing a supply of compressed air, said fluidic NOR gate having a supply port in fluid communication with said air supply means for providing a stream of air therethrough and a first channel leading from the supply port and being in fluid communication with the closed chamber of said valve means for normally providing a digital air signal to effect opening of said valve means, said fluidic NOR gate having a second channel leading from the first channel to an outlet port open to the atmospheric pressure, said fluidic NOR gate having a control jet to effect switching of the air stream from the first channel to the second channel, a passageway providing fluid communication between the control jet and said air supply means and having a vent portion open to atmospheric pressure, a valve member for restricting the flow of air from the vent portion of said passageway, and a bimetallic member connected to said valve member and responsive to variations in the temperature of the internal combustion engine for moving said valve member to close the vent portion of said passageway at a predetermined engine temperatures to effect closing of said valve means and being operable in response to engine temperatures greater than the predetermined engine temperature for moving said valve member to open the vent portion of said passageway to effect switching of the air stream from the second channel to the first channel to open said valve means.

* * * * *